US008721800B2

(12) United States Patent
Kim et al.

(10) Patent No.: US 8,721,800 B2
(45) Date of Patent: May 13, 2014

(54) METHOD OF CONTROLLING WASHING MACHINE

(75) Inventors: Hyun Bae Kim, Yongin-si (KR); Doo Young Ryu, Suwon-si (KR); Sung Mo Lee, Gunpo-si (KR); Kyo Soon Choi, Seoul (KR); Seung Hoon Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 706 days.

(21) Appl. No.: 12/453,671

(22) Filed: May 18, 2009

(65) Prior Publication Data

US 2010/0139011 A1 Jun. 10, 2010

(30) Foreign Application Priority Data

Dec. 5, 2008 (KR) ..... 10-2008-0123183

(51) Int. Cl.
*B08B 9/00* (2006.01)

(52) U.S. Cl.
USPC ..... 134/23; 8/148; 8/159; 134/32; 134/33; 134/34

(58) Field of Classification Search
None
See application file for complete search history.

(56) References Cited

U.S. PATENT DOCUMENTS

2005/0284192 A1* 12/2005 Altinier et al. ..... 68/12.06

FOREIGN PATENT DOCUMENTS

JP 10-272281 10/1998
KR 10-2007-0057569 6/2007

OTHER PUBLICATIONS

JPO machine translation of JP 10272281, retrieved from http://www4.ipdl.inpit.go.jp/Tokujitu/PAJdetail.ipdl?N0000=60&N0120=01&N2001=2&N3001=H10-272281 on Oct. 31, 2011.*

* cited by examiner

*Primary Examiner* — Eric Golightly
(74) *Attorney, Agent, or Firm* — Staas & Halsey LLP

(57) ABSTRACT

A method of controlling a washing machine, capable of detecting clothes contained in the washing machine by rotating a drum. The method includes supplying a predetermined amount of water when a barrel cleaning is executed, soaking an interior of a drum in water, draining water after the interior of the drum has been soaked in the water, and detecting clothes contained in the drum by rotating the drum. Whether to perform a barrel cleaning is determined according to the existence of the clothes in the drum, so that vibration and noise are prevented from being generated in the washing machine, and accident due to the movement of the washing machine is prevented.

11 Claims, 6 Drawing Sheets

METHOD OF CONTROLLING WASHING MACHINE

CROSS-REFERENCE TO RELATED APPLICATIONS

This application claims the benefit of Korean Patent Application No. 10-2008-0123183 filed on Dec. 5, 2008, in the Korean Intellectual Property Office, the disclosure of which is incorporated herein by reference.

BACKGROUND

1. Field

The present invention relates to a method of controlling a washing machine. More particularly, the present invention relates to a method of controlling a washing machine, capable of detecting clothes contained in a drum by rotating the drum.

2. Description of the Related Art

In general, a washing machine is a device used to remove dirt stained on clothes. According to such a washing machine, after supplying water into a washing tub such that the clothes are submerged in water, a predetermined amount of detergent is dissolved in the water to remove contaminants stained on the clothes through a chemical reaction with detergent and the washing tub having the clothes is rotated while generating friction and vibration against the clothes to mechanically remove the contaminants from the clothes.

In such a washing machine, after the washing operation on the clothes has been completed, the contaminants removed from the clothes or detergent residues may remain in the tub or the drum, and if the washing machine is repeatedly used for a long period of time, germ and mold may inhabit the inside of the tub. Such a contamination in the washing machine causes a bad odor, increases germs and re-contaminates clothes, thereby exerting bad influence upon the human body.

Accordingly, recently, a barrel cleaning course is added to a method of operating the washing machine to remove the contaminants or the detergent residue remaining in the tub or drum. Such a barrel cleaning course generally includes an operation of removing the contaminants remaining in the tub or drum using hot water or steam and an operation of rinsing the tub or drum by providing water inside the tub or drum.

SUMMARY

Accordingly it is an aspect of the present invention to provide a method of controlling a washing machine, capable of detecting clothes contained in a drum by rotating the drum.

It is another aspect of the present invention to provide a method of controlling a washing machine, capable of detecting clothes contained in a drum by rotating the drum and determining whether a tub cleaning is performed under the detected result.

Additional aspects and/or advantages of the invention will be set forth in part in the description which follows and, in part, will be apparent from the description, or may be learned by practice of the invention.

The foregoing and and/or other aspects are achieved by providing a method of controlling a washing machine, which includes supplying a predetermined amount of water when a barrel cleaning is executed, soaking an interior of a drum in water, draining water after the interior of the drum has been soaked in the water, and detecting clothes contained in the drum by rotating the drum.

According to an aspect, in the detecting of the clothes, the clothes contained in the drum may be detected by estimating inertia of the drum or inertia of the drum and the clothes.

According to an aspect, the method of controlling the washing machine further may include comparing the estimated inertia with an allowable inertia.

According to an aspect, determination whether the drum contains the clothes may be performed by comparing the estimated inertia with the allowable inertia.

According to an aspect, an rpm of the drum may be increased up to a first reference value and the rpm of the drum is maintained at the first reference value for a predetermined time, and then the rpm of the drum is increased up to a second reference value after the predetermined time has lapsed, thereby estimating the inertia.

According to an aspect, the inertia may be estimated by using a torque that is input to accelerate rotation of the drum, an accelerating time and a difference between the first reference value and the second reference value.

According to an aspect, in the detecting of the clothes, the clothes contained in the drum may be detected by estimating weight of the drum or weight of the drum and the clothes.

According to an aspect, the method of controlling the washing machine may further include comparing the estimated weight with an allowable weight.

According to an aspect, determination whether the drum contains the clothes may be performed by comparing the estimated weight with the allowable weight.

According to an aspect, an rpm of the drum may be increased up to a first reference value and the rpm of the drum is maintained at the first reference value for a predetermined time, and then the rpm of the drum is increased up to a second reference value after the predetermined time has lapsed, thereby estimating the weight.

According to an aspect, the weight may be estimated by using a torque that is input to accelerate rotation of the drum, an accelerating time and a difference between the first reference value and the second reference value.

It is another aspect of the present invention to provide a method of controlling a washing machine, which includes detecting a water level in a drum when a barrel cleaning is executed, supplying or draining water according to the detected water level such that a water level reaches a reference water level, soaking an interior of the drum in water, draining water after the interior of the drum is soaked in water, and detecting clothes contained in the drum by rotating the drum.

According to an aspect, in the detecting of the clothes, the clothes contained in the drum may be detected by estimating inertia of the drum or inertia of the drum and the clothes.

According to an aspect, the method of controlling the washing machine may include comparing the estimated inertia with an allowable inertia.

According to an aspect, determination whether the drum contains the clothes may be performed by comparing the estimated inertia with the allowable inertia.

According to an aspect, an rpm of the drum may be increased up to a first reference value and the rpm of the drum is maintained at the first reference value for a predetermined time, and then the rpm of the drum is increased up to a second reference value after the predetermined time has lapsed, thereby estimating the inertia.

According to an aspect, the inertia may be estimated by using a torque that is input to accelerate rotation of the drum, an accelerating time and a difference between the first reference value and the second reference value.

According to an aspect, in the detecting of the clothes, the clothes contained in the drum may be detected by estimating weight of the drum or weight of the drum and the clothes.

According to an aspect, determination whether the drum contains the clothes may be performed by comparing the estimated weight with the allowable weight.

According to an aspect, an rpm of the drum may be increased up to a first reference value and the rpm of the drum is maintained at the first reference value for a predetermined time, and then the rpm of the drum is increased up to a second reference value after the predetermined time has lapsed, thereby estimating the weight.

According to an aspect, the weight may be estimated by using a torque that is input to accelerate rotation of the drum, an accelerating time and a difference between the first reference value and the second reference value.

It is another aspect of the present invention to provide a method of controlling a washing machine, which includes estimating inertia or weight of a drum or the drum and clothes by rotating the drum when a barrel cleaning is executed, detecting if the drum contains the clothes according to the estimated inertia or weight, and executing a barrel cleaning stopping mode if it is detected that the clothes are contained in the drum.

According to an aspect, the method of controlling the washing machine may further include soaking the drum or soaking the drum and the clothes in water after a predetermined amount of water is supplied into the drum.

According to an aspect of the present invention, the method of controlling the washing machine may further include draining remaining water after water soaks in the drum or the drum and the clothes.

According to an aspect, in the detecting of the clothes, the estimated inertia may be compared with an allowable inertia, thereby detecting if the drum contains the clothes.

According to an aspect, in the detecting of the clothes, if the estimated inertia is larger than the allowable inertia, it may be determined that the drum contains the clothes.

According to an aspect, in the detecting of the clothes, the estimated weight may be compared with an allowable weight, thereby detecting if the drum contains the clothes.

According to an aspect, in the detecting of the clothes, if the estimated weight is larger than the allowable weight, it may be determined that the drum contains the clothes.

According to an aspect, in the barrel cleaning stopping mode, if the clothes are detected in the drum, an alarming signal may be generated.

According to an aspect, in the barrel cleaning stopping mode, if the clothes are detected in the drum, a washing operation may be performed.

According to an aspect, in the barrel cleaning stopping mode, if the clothes are detected in the drum, the barrel cleaning may be stopped.

As described above, the clothes contained in the drum may be detected by estimating inertia and weight of clothes to determine whether to perform a barrel cleaning. Accordingly, vibration and noise are prevented from being generated in the washing machine, and accident due to the movement of the washing machine is prevented.

In addition, even though an additional barrel cleaning safety apparatus may not be provided, when a barrel cleaning execution is ordered, the clothes contained in the drum are easily detected and it is determined whether to perform the barrel cleaning process. Accordingly, vibration and noise are reduced during the barrel cleaning process.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
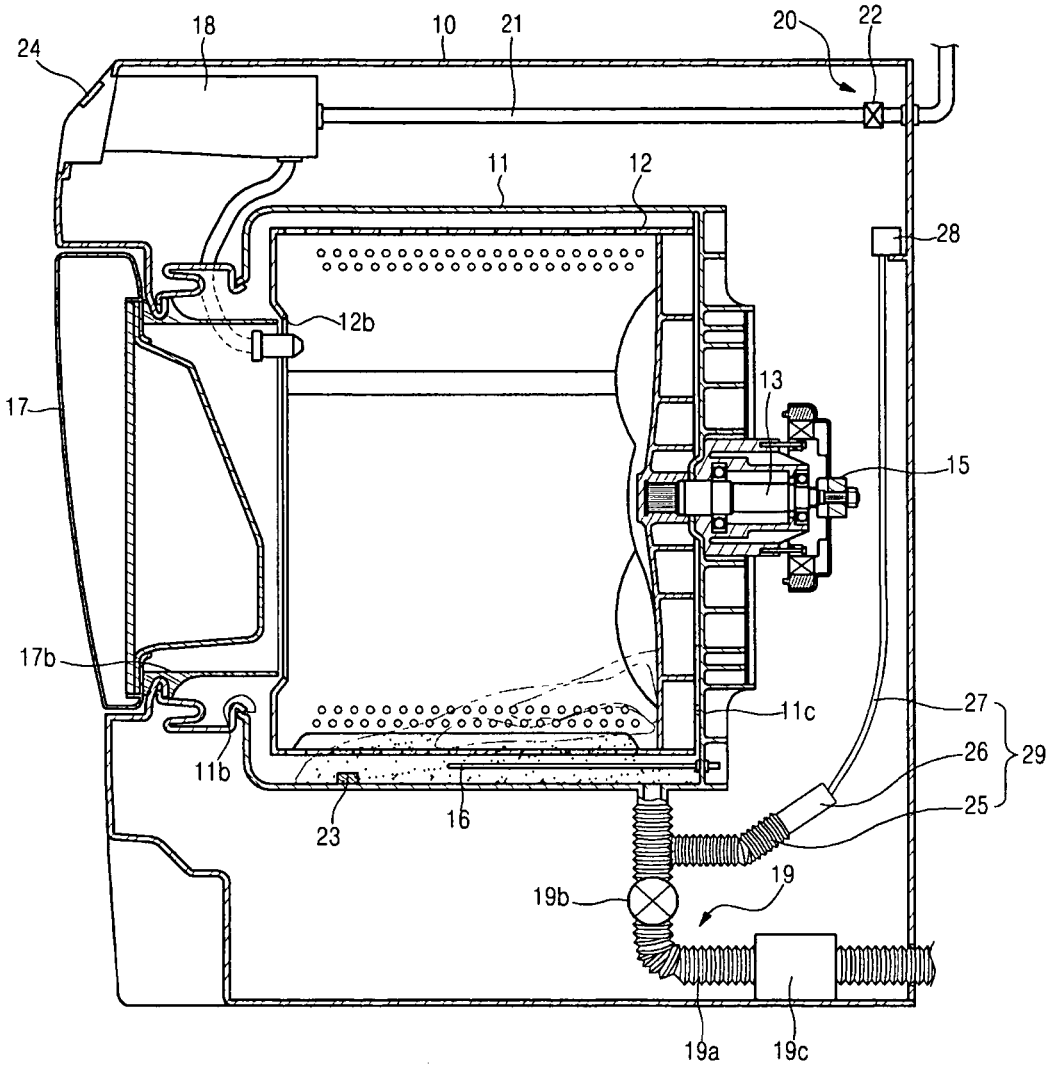
FIG. 1 is a sectional view representing a structure of a washing machine according to an embodiment.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, an embodiment will be described in detail with respect to accompanying drawings.

FIG. 1 is a sectional view representing a structure of a washing machine according to an embodiment.

As shown in FIG. 1, a washing machine according to an embodiment includes a drum-type water tub 11, which is installed inside a body 10 to contain water therein, and a rotating drum 12 rotatably installed inside the water tub 11.

A motor 15 is installed at an outer side of a rear surface 11*c* of the water tub 11 to rotate a rotary shaft 13 connected to the rotating drum 12 such that washing, rinsing and dehydration processes are performed. A heater 16 is installed at an inner lower side of the water tub 11 to heat the water provided in the water tub 11.

A detergent supply apparatus 18 is provided at an upper part of the water tub 11 to provide detergent. A water supply apparatus 20, which includes a water supply pipe 21 to provide water to the water tub 11, and a water supply valve 22, which is installed on the water supply pipe 21 to control water supply of the water supply pipe 21, are installed at the upper part of the water tub 11.

A drain apparatus 19 is provided at a lower portion of the water tub 11 to drain water to the outside. The drain apparatus 19 includes a water drain pipe 19*a*, a water drain valve 19*b* to intermittently drain water to the outside, and a drain pump 19*c* for pumping water out of the water tub 11.

A temperature sensor 23 is installed inside the water tub 11 to measure the temperature of water.

An opening 17*b*, which is open corresponding to an opening 12*b* of the rotating drum 12 and an opening 11*b* of the water tub 11, is installed at a front surface of the body 10 such that clothes are input into the rotating drum 12 or output from the rotating drum 12. A door 17 is installed at the opening 17*b* to open and close the opening 12*b*.

A control panel 24 is installed at an upper end of the front surface of the body to allow a user to input a command for a washing operation, a rinsing operation and dehydration operation through the control panel 24.

Reference numeral 29 represents a water level detection unit to detect a water level of water provided into the water tub 11. The water level detection unit 29 includes a water level detection apparatus 25 connected at one side of the drain apparatus 19, an air chamber 26, a water level detection tube 27 having a lower end connected to one side of the air chamber 26, and a water level sensor 28, which is connected to an upper end of the water level detection tube 27 to detect pressure of air contained in the water level detection tube 27 such that the water level is detected. The air chamber 26 is communicated with a lower end of the water level detection apparatus 25 and is filled with air to which pressure is applied depending on the water level in the water level detection apparatus 25.

Meanwhile, when a barrel cleaning is performed, the water level sensor 28 detects the level of water filled in the water tub 11 and transmits the information thereof to a control unit 31.

Figure 2:
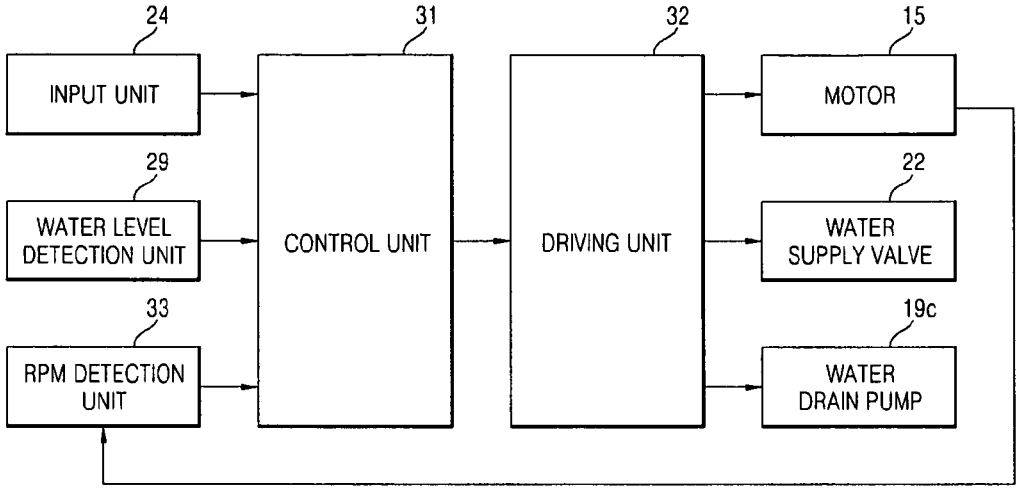
FIG. 2 is a block diagram of a washing machine according to the embodiment.

FIG. 2 is a block diagram of a washing machine according to the embodiment.

As shown in FIG. 2, the washing machine according to the embodiment includes an input unit 24, the water level detection unit 29, the control unit 31 and a driving unit 32.

The input unit 24 corresponds to the control panel 24, which allows the user to input the command for the washing, rinsing and dehydration operations or a particular course such as a barrel cleaning course. If operation information is input by a user, the input unit 24 transmits the information to the control unit 31.

The water level detection unit 29 includes the water level detection apparatus 25 connected at one side of the drain apparatus 19, the air chamber 26, the water level detection tube 27 having a lower end connected to one side of the air chamber 26, and the water level sensor 28, which is connected to an upper end of the water level detection tube 27 to detect pressure of air contained in the water level detection tube 27 such that the water level is detected. The air chamber 26 is communicated with the lower end of the water level detection apparatus 25 and is filled with air to which pressure is applied depending on the water level in the water level detection apparatus 25. The water level detection unit 29 detects the water level of the drum 12 to transmit the information thereof to the control unit 31.

An rpm (revolution per minute) detection unit 33 detects the rpm of the motor and transmits the information thereof to the control unit 31.

The control unit 31 corresponds to a microcomputer which controls the washing machine according to the operational information input through the input unit 24. The control unit 31 stores the amount of clothes, the rpm of the motor 15, an operating time (an on-off time of the motor) and a washing time in a selected washing course and controls the overall operation of the washing machine.

In addition, when the barrel cleaning is performed, the control unit 31 estimates inertia or weight generated by the drum 12 or the clothes of drum 12 by rotating the drum 12 and determines whether the barrel cleaning is performed according to the estimated inertia or weight.

In detail, if the user presses a start button for the barrel cleaning course, a safety operation starts to determine whether the clothes exist in the drum 12. Hereinafter, the safety operation will be described.

First, if the barrel cleaning is executed, the control unit 31 supplies a predetermined amount of water, for example, 10 L of water, into the drum, and rotates the drum 12 for a predetermined time to uniformly soak the clothes in the water. After that, in order to allow the clothes to be attached to an inner wall of the drum 12, the control unit 31 drives the drum 12 with an rpm having a first reference value, for example, 90 rpm, and the rpm of the drum 12 is maintained for a predetermined time such that the clothes sticking to the inner wall of the drum are uniformly spread. Then, the rpm of the drum is increased up to a second reference value, for example, 100 to 140 rpm, and the inertia or weigh of the drum 12 is estimated using torque input to increase the speed of the drum 12 from the first reference value to the second reference value, an accelerating time, and a difference between a final speed corresponding to the second reference value and an initial speed corresponding to the first reference value. The detailed equation will be described below with reference to FIG. 3. Meanwhile, the barrel described above represents the water tub 11 and the drum 12 of the washing machine.

Meanwhile, the driving unit 32 drives the motor 15, the water supply valve 22 and the drain pump 19*c* according to a control signal of the control unit 31.

Figure 3:
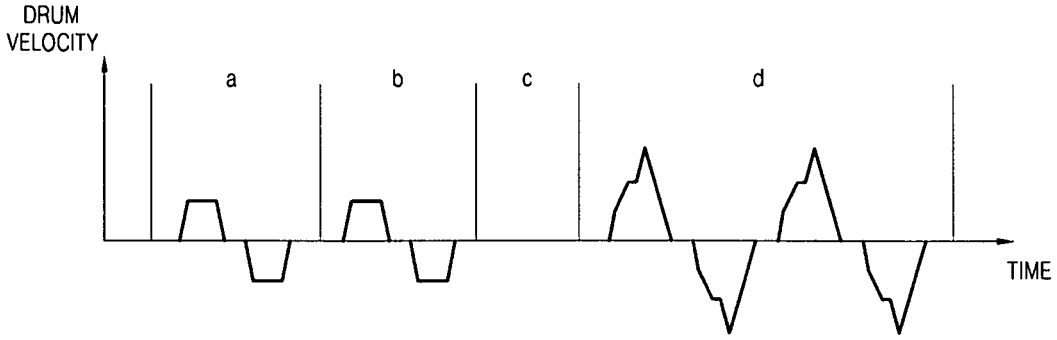
FIG. 3 is a graph illustrating an rpm variation of a drum when inertia or weight of the drum of the washing machine is estimated according to the embodiment.

FIG. 3 is a graph illustrating an rpm variation of a drum when inertia or weight of the drum of the washing machine is estimated according to the embodiment of the present invention.

As shown in FIG. 3, when the barrel cleaning is executed, the rpm of the drum 12 is adjusted corresponding to a water supply operation (a), a soaking operation (b), a water drain operation (c) and an inertia estimation operation (d) such that the inertia or the weight generated by the clothes contained in the drum 12 is estimated. That is, in operation (a), fixed quantity of water (for example, 10 L) is supplied into the inside of the drum 12 while rotating the drum 12 at 47 rpm. In operation (b), the drum 12 is rotated for a predetermined time (for example, 2 minutes) at 47 rpm such that the clothes are uniformly soaked in the water. Then, in operation (c), after the water soaks into the clothes contained in the drum 12 in operations (a) and (b), the remaining water is drained. In operation (d), the rpm is variously adjusted to estimate the inertia or weight of the drum 12.

That is, in operation (d), the rpm of the drum 12 is increased up to the first reference value, that is, 90 rpm, which is sufficient for allowing the clothes contained in the drum 12 to stick to the inner wall of the drum 12, and then the rpm is maintained in the first reference value for a predetermined time such that the clothes uniformly stick to the inner wall of the drum 12. After a predetermined time has lapsed, since the clothes in the drum 12 uniformly stick to the inner wall of the drum 12, the rpm of the drum 12 is increased up to the second reference value, that is, 100 to 140 rpm, to estimate the inertia. However, the reference value described above is illustrative purposes only, and can be changed according to the characteristics of the washing machine. Meanwhile, the detailed equation used to estimate the inertia of the drum 12 or the inertia of the drum 12 and the clothes using the reference value is as follows.

$$J*a=T \quad (1)$$

$$a=\Delta w/\Delta t \quad (2)$$

J=inertia a=rotational acceleration of the drum

T=input torque

Δw=variation of angular velocity of the drum=difference between the first reference value and the second reference value Δt=time variation According to the above equations, multiplication of the inertia J and the rotational acceleration a of the drum 12 corresponds to the input torque T. The input torque T is a physical factor causing the drum 12 to rotate, and the input torque T is set as a constant by the control unit 31. The rotational acceleration is variation of the rotational speed of the drum 12 with respect to time and is measured by the rpm detection unit 33. Accordingly, the inertia is detected through the equation described below.

$$J=T*(\Delta t/\Delta w)=\text{constant}*(\Delta t/\Delta w) \quad 3$$

That is, if the control unit 31 receives information ($\Delta w/\Delta t$) on the angular velocity of the drum 12 with respect to a predetermined time from the rpm detection unit 33, the control unit 33 multiplies the information on the angular velocity by the torque T having a constant, thereby obtaining the inertia J.

Meanwhile, the weight estimated by the drum 12 or the drum 12 and the clothes can be obtained through the equation described below using the reference value.

$$m=k*J \quad 4$$

k=constant m=weight

As described the above equation, the weight estimated by the drum 12 or the drum 12 and the clothes can be obtained by multiplying the estimated inertia J by the constant k. The above Equation 4 represents that the estimated inertia is proportional to the estimated weight, and the constant k is determined by a designer through various experiments in consideration of a factor such as a distance from a center of the drum 12 and the inner wall. However, when an allowable weight to be described below is determined, the value of the constant k must be considered. In detail, if the constant k is set, a weight estimated by multiplying the constant k by an allowable inertia is set as the allowable weight and is used to detect the distribution of the clothes in the drum 12.

Figure 4:
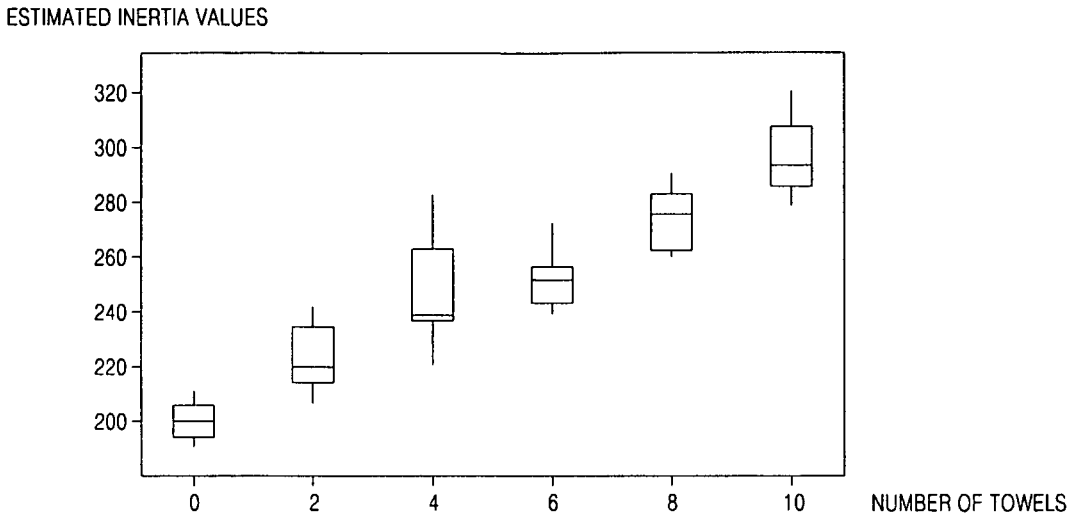
FIG. 4 is a graph representing a result of inertia detected according to the embodiment.

FIG. 4 is a graph representing inertia estimated according to the embodiment.

FIG. 4 is a result of inertia estimated according to the increase of the number of towels in the drum of the washing machine, and the estimated inertia is getting larger as the number of the towels in the drum 12 is increased. In addition, the inertia estimated by the clothes in the drum 12 is proportional to the weight of the clothes. Meanwhile, dry clothes have small inertia. Accordingly, the clothes in the drum 12 are soaked in the water such that the inertia is increased, thereby reducing an error of measurement.

Figure 5:
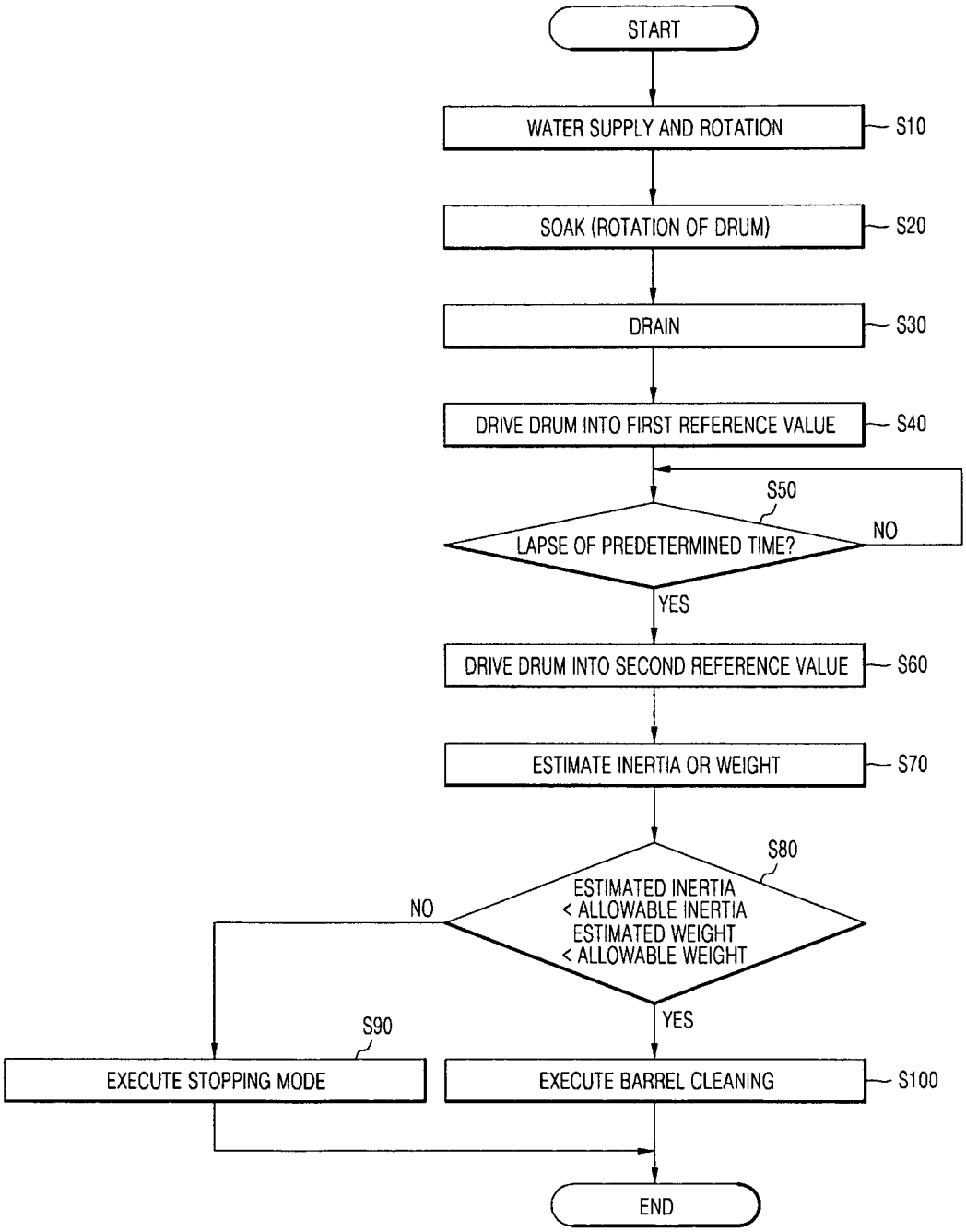
FIG. 5 is a flowchart representing a process of detecting inertia or weight of the drum of the washing machine according to a first embodiment.

FIG. 5 is a flowchart representing a process of detecting inertia or weight of the drum of the washing machine according to a first embodiment of the present invention.

As shown in FIG. 5, after the barrel cleaning starts, the control unit 31 supplies water inside the drum 12 by a predetermined water level and the drum 12 is rotated with a predetermined rpm (for instance, 47 rpm). A predetermined quantity of water is supplied to soak the clothes in the water such that the error is reduced when the inertia or weight is estimated (s10).

Then, the drum 12 is rotated at a predetermined velocity, thereby uniformly soaking the clothes in the water. For example, after 10 L of water has been supplied in operation 10, the drum 12 is rotated forward and backward for about 2 minutes at a predetermined velocity, for example, 47 rpm, which is sufficient for moving up and dropping down the clothes (s20).

After the clothes have been uniformly soaked in the water, the remaining water is drained. That is, water is drained after the drum 12 has been rotated for a predetermined period of time. Thus, in a state in which the drum 12 does not contain the water except for the water soaked into the clothes, the drum 12 rotates and is accelerated, thereby draining water to estimated the inertia of the drum 12 containing the clothes (s30).

Then, the motor 15 is driven such that the rpm of the drum 12 is increased up to the first reference value. That is, the rotational velocity of the drum 12 is increased up to a predetermined velocity, which is sufficient for allowing the clothes in the drum 12 to stick to the inner wall of the drum 12, that is, the first reference value (for example, 90 rpm) set by a manufacturer (s40).

Then, the rotational velocity of the drum is maintained at the first reference value in a state that the rotational velocity of the drum 12 reaches the first reference value. This process is performed such that the clothes stick to the inner wall of the drum 12 when the rpm of the drum 12 is increased up to the first reference value, and the clothes are uniformly spread on the inner wall of the drum 12 when the velocity of the drum 12 is maintained in the first reference value for a predetermined time (s50).

After the clothes are uniformly spread while sticking to the inner wall of the drum 12, the rotational velocity of the drum 12 is increased up to the second reference value. This process is performed to obtain a difference between the initial velocity corresponding to the first reference value and the final velocity corresponding to the second reference value and the accelerating time such that the inertia or weight is estimated through the above Equations 3 and 4 shown in FIG. 3 (s60).

After that, the control unit 31 puts the accelerating time measured when the velocity of the drum 12 is increased from the first reference value to the second reference value in operation 60, the difference between the initial velocity and the final velocity and the torque input during the acceleration in Equation 3, thereby estimating the inertia caused by the drum 12 and the clothes.

In addition, the control unit 31 puts the accelerating time measured when the velocity of the drum 12 is increased from the first reference value to the second reference value in operation s60, the difference between the initial velocity and the final velocity, the torque input during the acceleration and the constant in Equation 4, thereby estimating the weight of the drum 12 of the drum 12 and the clothes (s70).

Then, the allowable inertia is compared with the estimated inertia obtained in operation 70. The allowable inertia is set by the manufacturer based on the inertia estimated when the drum 12 does not contain the clothes. If an estimated inertia exceeds a predetermined level, noise and vibration occur or the washing machine is shaken when the barrel cleaning is performed.

In addition, the control unit 31 compares the estimated weight with the allowable weight. Similarly to the allowable inertia, the allowable weight can be set by the manufacturer based on the weight estimated when the drum 12 does not contain the clothes. Otherwise, as described above with reference to FIG. 3, the estimated weight obtained by multiplying the constant k by the allowable inertia can be determined as the allowable weight (s80).

After that, if the estimated inertia is determined to be larger than the allowable inertia, a stopping mode is performed. The stopping mode according to the embodiment of the present invention includes a first mode to raise an alarm signal the user through a display and to stop the barrel cleaning operation and a second mode to wash the clothes contained in the drum 12. In the case of the first mode, the user must take out the clothes contained in the drum 12 and resumes the barrel cleaning. In the case of the second mode, the normal washing operation including water supply, washing, rinsing and draining is performed, so the clothes existing in the drum 12 are washed. If the amount of clothes is small, the barrel including the water tub and the drum is washed. Meanwhile, if the estimated weight is larger than the allowable weight, the barrel cleaning is performed similarly to the barrel cleaning performed when the estimated inertia is larger than the allowable inertia (s90).

Meanwhile, when the estimated inertia is smaller than the allowable inertia, the barrel cleaning is performed. In addition, when the estimated weight is smaller than the allowable weight, the barrel cleaning is performed similarly to the barrel cleaning performed when the estimated weight is smaller than the allowable weight. Meanwhile, the barrel cleaning can be variously performed by supplying water in the water tub, heating the water to a predetermined sterilization temperature and then rotating the drum 12 such that the heated water is distributed over the entire area of the water tub or the drum 12. Otherwise, the barrel cleaning can be performed using steam (s100).

Figure 6:
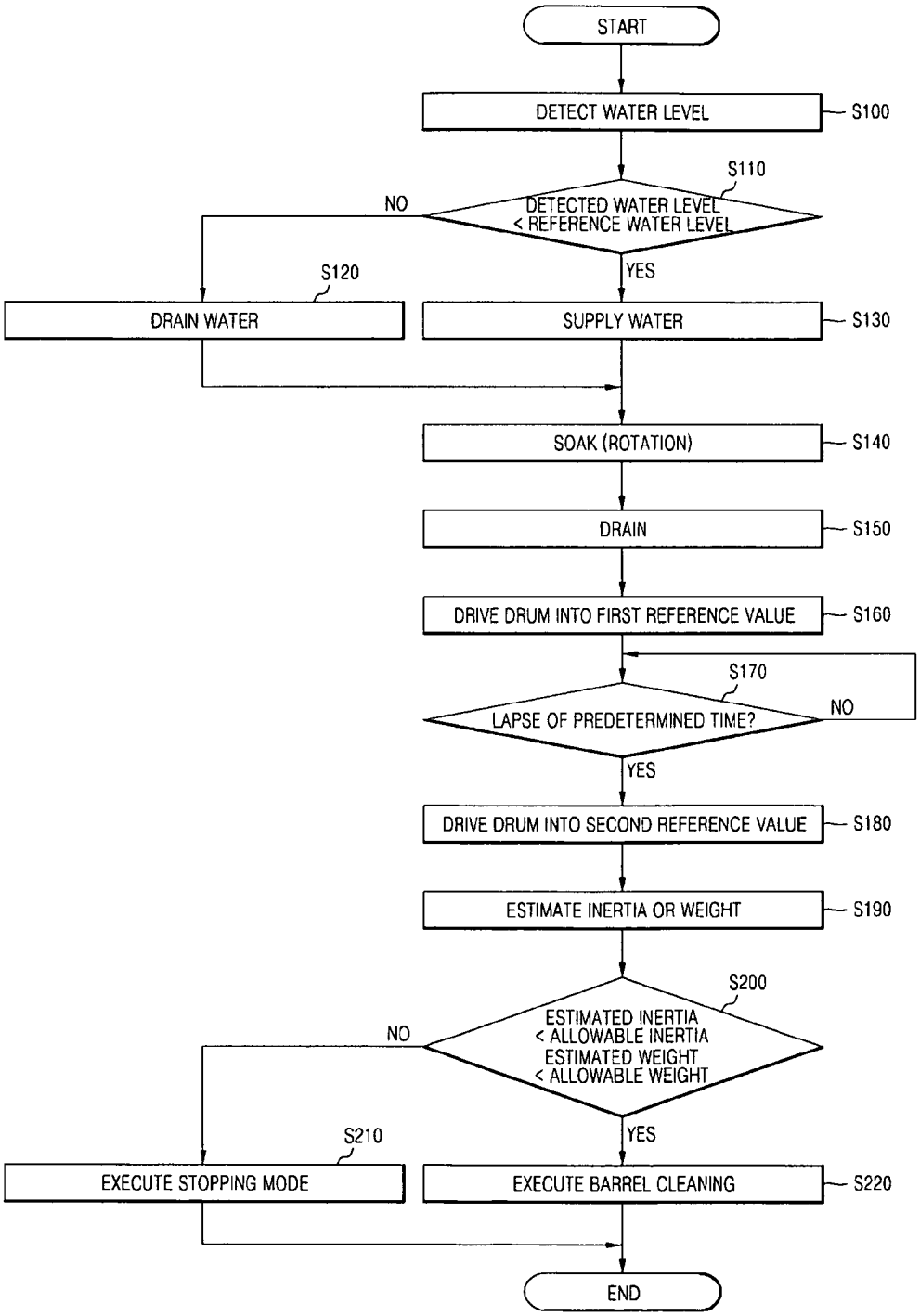
FIG. 6 is a flowchart representing a process of detecting inertia or weight of the drum of the washing machine according to a second embodiment.

FIG. 6 is a flowchart representing a process of detecting inertia or weight of the drum 12 of the washing machine according to a second embodiment. When compared with the first embodiment, the second embodiment is different from the first embodiment in that it is checked whether water exists in the drum 12 during the barrel cleaning to determine the supply of water according to the existence of water.

As shown in FIG. 6, when the barrel cleaning starts, the control unit 31 receives the information on a water level of the drum 12 through the water level detection unit 29 and compares the information on the water level of the drum 12 with a reference water level determined by the user. Since the clothes must be uniformly socked in water in the soaking operation to reduce the error generated when measuring the inertia or weight of the clothes in the drum 12, the process of comparing the water levels is necessary, and the reference water level represents a level of water supplied to soak the clothes in the drum 12 in the soaking operations (s100 and s110).

If the water level detected by the water level detection unit 29 is determined to be higher than the water level required to soak the clothes during the barrel cleaning, the water in the drum 12 is drained such that the water level reaches the reference water level (s120).

Meanwhile, in operation s110, the water level detected by the water level detection unit 29 is determined to be lower than the water level required to soak the clothes during the barrel cleaning, water is additionally supplied. Since the clothes must be uniformly soaked in water to reduce the error generated when measuring the inertia or weight of the clothes in the drum 12, the process of supplying water is necessary (s130).

Meanwhile, since remaining operations s140 to s220 according to the second embodiment are identical to operations s20 to s100, the description thereof will be omitted.

Although few embodiments of the present invention have been shown and described, it would be appreciated by those skilled in the art that changes may be made in these embodiments without departing from the principles and sprit of the invention, the scope of which is defined in the claims and their equivalents.

What is claimed is:

1. A method of controlling a washing machine having a drum to receive clothes and a motor to rotate the drum, the method comprising:

when a barrel cleaning mode is selected by a user, performing a safety operation to determine if clothes are in the drum prior to starting the barrel cleaning mode, the safety operation comprising supplying a predetermined amount of water to an interior of the drum, soaking the interior of the drum in the water by rotating the drum, draining the water after the interior of the drum has been soaked in the water, and detecting whether clothes exist in the drum after the draining of the water;

starting the barrel cleaning if no clothes are detected in the drum; and not starting the barrel cleaning if clothes are detected in the drum.

2. The method as claimed in claim 1, wherein detecting whether clothes exist in the drum comprises estimating inertia of the drum or inertia of the drum and the clothes.

3. The method as claimed in claim 2, further comprising comparing the estimated inertia with an allowable inertia.

4. The method as claimed in claim 3, wherein determination whether the drum contains the clothes is performed by comparing the estimated inertia with the allowable inertia.

5. The method as claimed in claim 2, wherein an rpm of the drum is increased up to a first reference value and the rpm of the drum is maintained at the first reference value for a predetermined time, and then the rpm of the drum is increased up to a second reference value after the predetermined time has lapsed, thereby estimating the inertia.

6. The method as claimed in claim 5, wherein the inertia is estimated by using a torque that is input to accelerate rotation of the drum, an accelerating time and a difference between the first reference value and the second reference value.

7. The method as claimed in claim 1, wherein in the detecting of the clothes, the clothes contained in the drum is detected by estimating weight of the drum or weight of the drum and the clothes.

8. The method as claimed in claim 7, further comprising comparing the estimated weight with an allowable weight.

9. The method as claimed in claim 8, wherein determination whether the drum contains the clothes is performed by comparing the estimated weight with the allowable weight.

10. The method as claimed in claim 7, wherein an rpm of the drum is increased up to a first reference value and the rpm of the drum is maintained at the first reference value for a predetermined time, and then the rpm of the drum is increased up to a second reference value after the predetermined time has lapsed, thereby estimating the weight.

11. The method as claimed in claim 10, wherein the weight is estimated by using a torque that is input to accelerate rotation of the drum, an accelerating time and a difference between the first reference value and the second reference value.

* * * * *

UNITED STATES PATENT AND TRADEMARK OFFICE

CERTIFICATE OF CORRECTION

PATENT NO. : 8,721,800 B2
APPLICATION NO. : 12/453671
DATED : May 13, 2014
INVENTOR(S) : Hyun Bae Kim et al.

It is certified that error appears in the above-identified patent and that said Letters Patent is hereby corrected as shown below:

In the Claims,

Column 10, Line 36-38, In Claim 7, Delete "in the detecting of the clothes, the clothes contained in the drum is detected by" and insert -- detecting whether clothes exist in the drum comprises --, therefor.

Signed and Sealed this
Twenty-third Day of December, 2014

Michelle K. Lee

Michelle K. Lee
*Deputy Director of the United States Patent and Trademark Office*